United States Patent [19]

Weber et al.

[11] 4,447,985

[45] May 15, 1984

[54] WINDOW STRUCTURE

[75] Inventors: Ronald J. Weber; Gene T. Pagel, both of Wausau, Wis.

[73] Assignee: Wausau Metals Corporation, Wausau, Wis.

[21] Appl. No.: 388,752

[22] Filed: Jun. 16, 1982

[51] Int. Cl.[3] ..... E05D 7/00

[52] U.S. Cl. ..... 49/400; 49/402; 49/501; 49/DIG. 1

[58] Field of Search ..... 49/400, 402, DIG. 1, 49/501, 381; 52/398, 397, 208

[56] References Cited

U.S. PATENT DOCUMENTS

| | | | |
|---|---|---|---|
| 3,203,053 | 8/1965 | Lane et al. | 52/398 X |
| 3,566,539 | 3/1971 | Ridgley | 49/400 X |
| 3,678,626 | 7/1972 | Heikel | 49/402 |
| 4,132,035 | 1/1979 | Frambach | 49/381 X |
| 4,309,845 | 1/1982 | Schmidt | 49/501 |
| 4,314,424 | 2/1982 | Gordon et al. | 49/400 |

*Primary Examiner*—Philip C. Kannan

*Attorney, Agent, or Firm*—Isaksen, Lathrop, Esch, Hart & Clark

[57] ABSTRACT

A window structure (10) having an exterior side (12) and an interior side (14). The window structure (10) includes a stationary casing (22) closed by a movable sash (26) that is fastened to the stationary casing (22) in hinged relation. The stationary casing (22) has an exterior panel (28) located exterior to the sash (26) and extending over the sash (26) to overlap its periphery. A gasket (30) is fastened to the exterior panel (28) and faces interiorly, generally toward the sash (26). The sash has an exteriorly facing mounting surface (40), and a glazing support member (42) extends exteriorly therefrom. A window lite (46) is mounted in spaced relation to the mounting surface (40). The window lite (46) has an exterior surface (48) that engages the gasket (30) in sealing relation when the sash (26) is in its closed position and an interior surface (49) facing the mounting surface (40). A glazing channel (44) is defined by the window lite interior surface (49), the mounting surface (40), and the adjacent portion of the glazing support member (42), the glazing channel (44) opening toward the sash opening (39). A structural bonding member (54) extends within a selected portion of the glazing channel (44) adjacent to the sash opening (39), structurally engaging the interior surface (49) and the mounting surface (40).

14 Claims, 3 Drawing Figures

WINDOW STRUCTURE

TECHNICAL FIELD

This invention relates to window structures in general and, in particular, to window structures utilizing no glazing bead.

TECHNICAL BACKGROUND

The technical field is generally cognizant of window structures in which a window lite is set within a glazing channel and held therein by a rigid glazing bead. The use of such a bead allows the glazing channel to be open and unobstructed on one side. This arrangement permits the window lite to be placed in the channel from its open side without the need to disassemble the frame in which the channel is formed. This facilitates the manufacture of windows and the replacement of broken window lites. Furthermore, it is advantageous in constructing a rigid window frame to be able to lock the frame members together permanently without having to provide for their disassembly for glazing.

In certain applications, it is considered esthetically advantageous to provide a window structure with an openable sash in which substantially no part of the sash extends beyond the exterior surface of the window lite. However, such an arrangement is impossible when the window lite is to be held in the sash by means of a glazing channel and bead. Furthermore, the lack of a sash member extending beyond the exterior surface of the window lite makes difficult the proper sealing of such a sash when it is closed. Conventional peripheral weatherstripping interferes with the esthetic goal of providing a window sash in which a minimum of sash frame is visible from the exterior side, and no sash structure extends exterior to the window light to provide a surface against which a seal may press.

The field is cognizant of the desirability of reducing heat flow between the exterior and interior sides of metallic window structures. It is conventional to include structural heat transfer barriers in metallic window structures to interrupt what might otherwise be a continuous, metallic path by which heat could flow between the interior and exterior parts of the window structure. However, conventional structural heat transfer barriers are relatively bulky. Their incorporation in a window sash in such a way as to prevent the flow of heat between interior and exterior sides of the window lite frustrates the goal of reducing to the greatest extent possible that part of the sash which is visible from its exterior side.

BRIEF SUMMARY OF THE INVENTION

The present invention is summarized in that a window structure having an exterior side and an interior side includes a stationary casing defining the perimeter of the window structure and of a window opening. A movable sash is fastened to the stationary casing in hinged relation. The sash has an open position and a closed position in which it closes the window opening. The sash has sash frame members defining the perimeter of the sash and of a sash opening. An exterior panel is located exterior to the sash and forms part of the stationary casing. The exterior panel extends over the sash to overlap its periphery. A gasket is fastened to the exterior panel and faces interiorly, generally toward the sash. Surfaces of the sash frame members define an exteriorly facing mounting surface. A glazing support member extends exteriorly from the mounting surface. A window lite is mounted adjacent to the mounting surface to close the sash opening. The window lite has an exterior surface adapted to engage the gasket in sealing relation when the sash is in its closed position. The mounting surface, glazing support member and window lite define a glazing channel opening toward the sash opening. A structural bonding member extends between the window lite and the glazing channel, bonding the window lite to the sash.

A primary object of the invention is to provide a window structure having a movable sash wherein no part of the sash extends beyond the exterior surface of the window lite.

A second object of the invention is to provide a window structure having a movable sash in which no part of the sash is visible from outside the window structure when the sash is in its closed position and a minimum of the sash is visible from the exterior side of the sash when it is in its open position.

Another object of the invention is to provide a metallic window structure in which no continuous metallic heat flow path exists between the exterior and interior sides of the window structure.

A further object of the invention is to provide a window structure in which the window lite may be installed both without the need to disassemble any part of the window structure and without the use of a rigid glazing bead.

Other objects, features, and advantages of the invention will be apparent from the following detailed description taken in conjunction with the accompanying drawings showing a preferred embodiment of the window structure of the invention.

DETAILED DESCRIPTION OF THE PREFERRED EMBODIMENT

Figure 1:
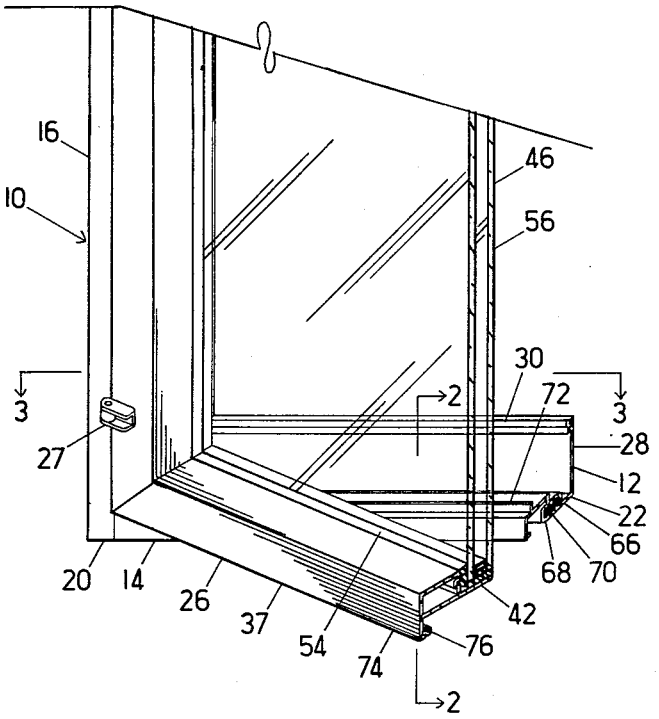
FIG. 1 is a perspective view of a broken away portion of a window structure made in accord with the invention, with the sash partially open.

Referring more particularly to the drawings, FIG. 1 shows a novel window structure made in accord with the invention, shown generally at 10. The window structure 10 has an exterior side 12 and an interior side 14. Each part of the window structure 10 thus has an interior and exterior side.

In the preferred embodiment, the window structure 10 is rectangular. The window structure 10 has a stationary casing 22 that defines the perimeter of the window structure and of a window opening 24. The stationary casing 22 has opposing side members 16 that extend for the height of the window structure 10. Opposing top member (not shown) and bottom member 20 extend between the side members 16 at their top and bottom ends. The window structure 10 has a movable sash 26 fastened to the stationary casing 22 in hinged relation by means of conventional hinges 27. The movable sash 26 has an open position in which it opens interiorly and a closed position in which it closes the window opening 24.

The stationary casing 22 has an exterior panel 28 exterior to the sash 26 that extends over the sash 26 to overlapping its periphery. A gasket 30 is fastened to the exterior panel 28 and faces interiorly, generally toward the sash 26. Preferably the gasket 30 is made of a deformable material such as neoprene. A gasket fastening member 32 may be formed along the length of the gasket 30. Such a gasket fastening member 32 may have a neck portion 34, extending outwardly from the back of the gasket 30 for a selected distance, and a holding portion 36 remote from the gasket 30 and wider than the neck portion. A fastening channel 38 may extend along the length of the exterior panel 28. The fastening channel 38 may have a cross sectional shape similar to that of the gasket fastening member 32, so that the gasket fastening member 32 may be matably engaged within it, thus fastening the gasket 30 to the exterior panel 28. Such a means of fastening shall be referred to hereinafter as a fastening member and channel system.

Sash frame members 37 define the perimeter of the sash 26 and of a sash opening 39. Surfaces of the sash frame members 37 define an exteriorly facing mounting surface 40. A glazing support member 42 extends exteriorly from the mounting surface 40.

A window lite 46 is mounted upon the mounting surface 40, in spaced relation therefrom, closing the sash opening 39. The window lite 46 has an exterior surface 48 and an interior surface 49 facing the mounting surface 40. Preferably neither the glazing support member 42 nor any other rigid part of the sash 26 extends beyond the exterior surface 48. The glazing support member 42 substantially covers the periphery of the window lite 46, protecting it from mechanical damage and supporting its weight, as is further described below. When the sash 26 is in its closed position, the exterior surface 48 of the window lite 46 engages the gasket 30 in sealing relation. Thus, when the sash 26 is in its closed position, no exteriorly exposed part of the sash is visible from the exterior side 12 of the window structure 10. When the sash 26 is in its open position, the exterior surface 48 of the window lite 46 is entirely unobstructed by any part of the sash.

Figure 2:
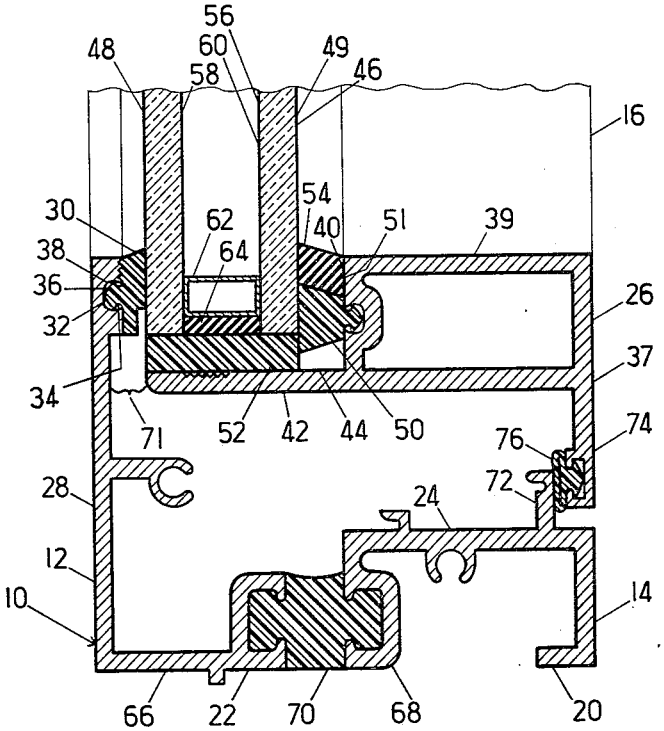
FIG. 2 is a cross sectional view of the bottom member of the window structure of FIG. 1 taken along section lines 2—2 with the sash in its closed position.

A glazing channel 44 is defined by the opposed portions of the interior surface 49 of the window lite 46 and the mounting surface 40 and the portion of the glazing support member 42 that extends therebetween. The glazing channel 44 opens toward the sash opening 39. Preferably, a spacer 50 extends for the length of the mounting surface 40 and is fastened thereto. The spacer may be of a deformable material such as dense neoprene or silicone rubber. It may be fastened to the mounting surface 40 by a fastening member and channel system, as described above. The spacer 50 is interposed between a selected portion of the mounting surface 40 and the interior side 49 of the window lite 46. A portion of the mounting surface 40 adjacent to the sash opening 39 is not covered by the spacer 50. Parts of interior surface 49 of the window lite 46, mounting surface 40, and spacer 50 thus form a bonding member channel 51 opening toward the sash opening 39, interior to the window lite 46. At least one setting block 52 is placed on the glazing support member 42 of the sash member 37 that is adjacent to the bottom member 20 of the window structure 10, as is shown in FIG. 2. As may be seen in the embodiment shown in FIG. 2, the setting block 52 is structurally independent of the structural bonding member 54. The setting block 52 is interposed between the glazing support member 42 and the window lite 46 and serves to support the weight of the window lite 46, holding it in a desirably centered location between the bottom member 20 and the top member 28 of the window structure 10. The setting block 52 is made of a relatively incompressible material, such as dense neoprene.

A structural bonding member 54 extends within the glazing channel 44, between the interior surface 49 of the window lite 46 and the mounting surface 40, bonding the window lite to the sash 26. Preferably the structural bonding member 54 is made by flowing conventional structural silicone rubber between the window lite 46 and the mounting surface 40 from the interior side of the sash 26 until the bonding member channel 51 has been filled. Thus, the silicone rubber is applied to the glazing channel 44 at locations adjacent to the sash opening 39. The bond between conventional silicone rubber, the mounting surface 40 and the interior surface 49 of the window lite 46 is sufficiently strong to retain the window lite within the sash 26 without the use of any glazing bead on the exterior side of the window lite.

Preferably the window lite 46 is a conventional double glazing unit 56. The double glazing unit 56 has an exterior pane 58 and an interior pane 60. The exterior and interior panes 58, 60 are spaced from each other by a pane spacer 62. The pane spacer 62 extends parallel to the peripheries of the exterior and the interior panes 58, 60 at a selected distance therefrom. The space between the pane spacer 62 and the peripheries of the exterior and interior panes 58, 60 is filled with a bonding agent 64 that permanently bonds them together. Structural silicone rubber may be employed as the bonding agent 64.

The rigid parts of the stationary casing 22 may be conveniently made and conventionally are made of extruded aluminum, although other forming methods and other metals and suitable plastics may also be used. In the preferred embodiment, such parts are metallic and will be referred to as such hereinafter. The stationary casing 22 includes an exterior casing member 66 and an interior casing member 68. The exterior casing member 66 and interior casing member 68 extend the length of the stationary casing 22 and are rigidly connected and spaced from each other by a conventional structural heat transfer barrier 70, such as that disclosed in Nilsen, U.S. Pat. No. 3,204,324. The structural heat transfer barrier 70 is made from a polyethylene resin or other suitable material having a substantially lower heat conductivity than the exterior and interior casing members 66, 68.

Preferably the gasket 30 is formed of a material of reduced heat conductivity, such as closed cell neoprene. The gasket 30 holds the window lite 46 and associated sash 26 away from the exterior casing member 66, so that a selected distance is maintained between them when the sash is in its closed position. Thus, an insulating space 71 separates the metallic parts of the sash 26 and the exterior casing member 66. The insulating space 71 may be filled with air or with any appropriate insulating material of reduced heat flow transmitting properties. Consequently, no continuous metallic heat flow path exists between the exterior and interior sides 12, 14 of the window structure 10 uninterrupted by one of a structural heat transfer barrier and material of reduced heat flow transmitting properties.

Preferably the interior casing member 68 includes a stop member 72 that extends toward the sash 26 for a selected distance when the sash is in the closed position. The sash 26 includes an interior panel 74 that extends toward the interior casing member 68 at a location interior to the stop member 72. Weatherstripping 76 is attached to the interior panel 74 and faces the stop member 72. When the sash 26 is in its closed position, the weatherstripping 76 engages the stop member 72 in sealing relation. By this means, no part of the exterior casing member 66 is exposed to air from the interior side 14 of the window structure 10 when the sash 26 is in its closed position. The weatherstripping 76 may be conveniently made from conventional closed cell neoprene bulb weatherstrip. It may be attached to the interior panel 74 by means of a fastening member and channel system, as described above.

Figure 3:
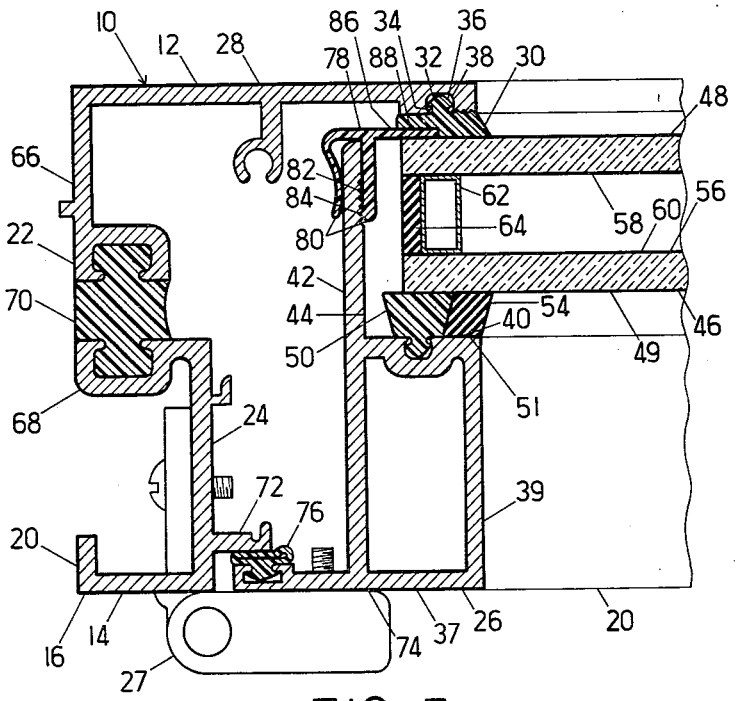
FIG. 3 is a cross sectional view of a side member of the window structure of FIG. 1 taken along section lines 3—3 with the sash in its closed position.

In practice, it sometimes is convenient to manufacture and ship to the point of use the window lite 46 separately from the remainder of the window structure 10. The metallic parts of the window structure 10 are first installed in the building which is to incorporate the window structure. The window lite 46 is then installed in the sash 26. With the sash 26 in its open position and with the gasket 30, spacer 50, and weatherstripping 76 in place, the setting blocks 52 are put in place on the glazing support member 42 of the sash member 37 adjacent to the bottom member 20. The window lite 46 is then set in place. A selected number of retainer clips 78 (shown in FIG. 3) are then pressed over the exteriorly extending parts of the glazing support member 42.

The retainer clips 78 have opposed grasping members 80 adapted to snap over the glazing support member 42 and to hold it therebetween in pinched relation. Corrugations 82 may be conveniently formed in the glazing support member 42, and a grasping member 80 may have a ridge 84 adapted to engage the corrugations 82 so as to more firmly hold the retainer clip 78 on the glazing support member 42. The retainer clip 78 has a window lite retainer member 86 that extends over the exterior surface 48 of the window lite 46 for a selected distance. With the window lite 46 in place in relation to the mounting surface 40 and supported by the setting blocks 52, sufficient numbers of retainer clips 78 are put into place to hold the window lite 46 as the sash 26 is carefully moved to the closed position. The gasket 30 may have an interiorly facing channel 88 adapted to receive the window lite retaining members 86 when the sash 26 is in its closed position. The structural bonding member 54 is then put in place from the interior side 14 of the window structure 10, as is described above. After the bonding member 54 has cured sufficiently to bond the window lite 46 to the sash 26, the sash is again opened, and the retainer clips 78 are removed and discarded.

When circumstances permit, however, it is preferred to glaze the window structure 10 at the point of manufacture. The metallic parts of the window structure 10 are assembled and held in a suitable jig of conventional sorts. Glazing may then proceed as disclosed above when the window structure 10 is glazed at the point of use.

Although in the preferred embodiment, the sash 26 opens inwardly, as has been described above, it will be appreciated that the orientation of the window structure 10 may be reversed in all respects so that the sash 26 opens exteriorly. Likewise, an opaque panel or the like may be substituted for the window lite 46 without a departure from the scope and spirit of the invention. Conventional handles, clamps, hinges and locks may be incorporated in the window structure 10. The window structure 10 may be used as part of window units having both the openable structure disclosed above and permanently closed window lites. Conventional weepholes, sills, and ancillary frame members convenient in the installation and use of the window structure 10 all may be added without departure from the scope and spirit of the invention. All metallic, neoprene, plastic, or other parts of the invention may be fashioned by extrusion or other conventional means of working such materials.

It is understood that the invention is not confined to the particular construction, materials, and arrangement of parts herein illustrated and described, and that various changes may be made without departing from the spirit of the invention. The invention embraces all such modified forms thereof as come within the scope of the following claims.

What is claimed is:

1. A window structure (10) having an exterior side (12) and an interior side (14), comprising:

(a) a stationary casing (22) defining the perimeter of the window structure (10) and of a window opening (24);

(b) a movable sash (26) fastened to the stationary casing (22) in hinged relation, having an open position and a closed position in which it closes the window opening (24), the sash (26) having sash frame members (37) defining the perimeter of the sash (26) and of a sash opening (39), surfaces of the sash frame members (37) defining an exteriorly facing mounting surface (40);

(c) an exterior panel (28) located exterior to the sash (26) and forming part of the stationary casing (22), the exterior panel (28) extending over the sash (26) to overlap its periphery;

(d) a gasket (30) fastened to the exterior panel (28) and facing interiorly, generally toward the sash (26);

(e) a window lite (46) mounted in spaced relation to the mounting surface (40) to close the sash opening (39), the window lite (46) having an exterior surface (48) adapted to engage the gasket (30) in sealing relation when the sash (26) is in its closed position and an interior surface (49) facing the mounting surface (40);

(f) a glazing support member (42) extending exteriorly from the mounting surface (40) to cover the edges of the window lite (46);

(g) a glazing channel (44) defined by the window lite interior surface (49), the mounting surface (40), and the adjacent portion of the glazing support member (42), the glazing channel (44) opening toward the sash opening (39); and (h) a structural bonding member (54) extending within a selected portion of the glazing channel (44) adjacent to the sash opening (39) and adapted to be inserted into the glazing channel (44) therefrom, structurally engaging the interior surface (49) and the mounting surface (40), to bond the window lite (46) to the sash (26) in supporting relation.

2. The window structure (10) of claim 1 wherein the stationary casing (22) has an exterior casing member (66) and an interior casing member (68) fastened together by a structural heat transfer barrier (70), whereby no continuous heat transfer path exists between the exterior and interior sides of the stationary casing (22) uninterrupted by the structural heat transfer barrier (70).

3. The window structure (10) of claim 2 wherein the glazing support member (42) is separated from the exterior casing member (66) by an insulating space (71) of selected dimension when the sash (26) is in its closed position and the gasket (30) is made of a material of reduced heat flow transmitting properties, whereby no continuous heat flow path exists between the exterior and interior sides (12, 14) of the window structure (10) uninterrupted by one of a structural heat transfer barrier (70), an insulating space (71), and a gasket (30).

4. The window structure (10) specified in claim 3 wherein (a) the stationary casing (22) includes a stop member (72) located interiorly from the structural heat transfer barrier (70), the stop member (72) extending toward the sash (26) for a selected distance when the sash (26) is in the closed position;

(b) the sash (26) includes an interior panel (74) that extends toward the stationary casing (22) at a location interior to the stop member (72); and (c) weatherstripping (76) is attached to one of the interior panel (74) and the stop member (72), the weatherstripping (76) engaging the other of the interior panel (74) and the stop member (72) in sealing relation when the sash (26) is in its closed position to prevent the exposure of any part of the exterior casing member (66) to air from the interior side (14) of the window structure (10).

5. The window structure (10) specified in claim 1, 2, 3, or 4 wherein:

(a) a spacer (50) extends for the length of the mounting surface (40), interposed between a selected portion of the mounting surface (40) and the interior side (49) of the window lite (46), the size and location of the spacer (50) selected to be such that a portion of the mounting surface (40) adjacent to the sash opening (39) is not covered by the spacer (50), so that the spacer (50) and opposing parts of the interior surface (49) of the window lite (46) and mounting surface (40) define a bonding member channel (51); and (b) the structural bonding member (54) substantially fills the bonding member channel (51).

6. The window structure (10) specified in claim 5 including at least one setting block (52) structurally independent of the structural bonding member (54) and located between the periphery of the window lite (46) and a selected portion of the glazing support member (42) and adapted to support the weight of the window lite (46) independent of the structural bonding member (54) and to hold it in a selected location within the sash (26).

7. The window structure (10) specified in claim 6 wherein the structural bonding member (54) is made of silicone rubber.

8. The window structure (10) specified in claim 6 wherein the window lite (46) includes an exterior pane (58) and an interior pane (60) located interiorly from and parallel to the exterior pane (58), spaced therefrom by a pane spacer (62) and bonded thereto by a bonding agent (64) to form a double glazing unit (56).

9. The window structure (10) specified in claim 8 wherein the structural bonding member (54) is made of silicone rubber.

10. A window structure (10) having an exterior side (12) and an interior side (14), comprising:

(a) a stationary casing (22) defining the perimeter of the window structure (10) and of a window opening (24), the stationary casing (22) having an exterior casing member (66) and an interior casing member (68) fastened together by a structural heat transfer barrier (70), whereby no continuous heat transfer path exists between the exterior and interior sides of the stationary casing (22) uninterrupted by the structural heat transfer barrier (70);

(b) a movable sash (26) fastened to the stationary casing (22) in hinged relation, having an open position and a closed position in which it closes the window opening (24), the sash (26) having sash frame members (37) defining the perimeter of the sash (26) and of a sash opening (39);

(c) an exterior panel (28) located exterior to the sash (26) and forming part of the exterior casing member (66), the exterior panel (28) extending over the sash (26) to overlap its periphery;

(d) a gasket (30) made of a material of reduced heat flow transmitting properties, fastened to the exterior panel (28), and facing interiorly, generally toward the sash (26);

(e) surfaces of the sash frame members (37) defining an exteriorly facing mounting surface (40);

(f) a window lite (46) mounted in spaced relation to the mounting surface (40) to close the sash opening (39), the window lite (46) having an interior surface (49) opposed to the mounting surface (40) and an exterior surface (48) adapted to engage the gasket (30) in sealing relation when the sash (26) is in its closed position;

(g) a spacer (50) extending for the length of the mounting surface (40), interposed between a selected portion of the mounting surface (40) and the interior side (49) of the window lite (46), the size and location of the spacer (50) selected to be such that a portion of the mounting surface (40) adjacent to the sash opening (39) is not covered by the spacer (50), so that the spacer (50) and opposing parts of the interior surface (49) and the mounting surface (40) define a bonding member channel (51) opening toward the sash opening (39);

(h) a structural bonding member (54) substantially filling the bonding member channel (51) and adapted to be inserted therein from the sash opening, bonding the window lite (46) to the sash (26) in structurally supporting relation;

(i) a glazing support member (42) extending exteriorly from the mounting surface (40) to a position adjacent to the exterior surface (48) of the window lite (46) to cover the periphery of the window lite (46), the glazing support member (42) being separated from the exterior casing member (66) by an insulating space (71), so that no continuous heat flow path exists between the exterior and interior sides (12, 14) of the window structure (10) uninterrupted by one of a structural heat transfer barrier (70), an insulating space (71) and a material of reduced heat flow transmitting properties; and (j) a stop member (72), located interiorly from the structural heat transfer barrier (70), extending toward the sash (26) for a selected distance when the sash (26) is in the closed position, an interior panel (74) extending from the sash (26) toward the stationary casing (22) at a location interior to the stop member (72), and weatherstripping (76) attached to one of the interior panel (74) and the stop member (72) and adapted to engage the other of the interior panel (74) and the stop member (72) in sealing relation when the sash (26) is in its closed position to prevent the exposure of any part of the exterior casing member (66) to air from the interior side (14) of the window structure (10).

11. The window structure (10) specified in claim 10 wherein the window lite (46) includes an exterior pane (58) and an interior pane (60) located interiorly from and parallel to the exterior pane (58), spaced therefrom by a pane spacer (62) and bonded thereto by a bonding agent (64) to form a double glazing unit (56).

12. The window structure (10) specified in claim 10 wherein the structural bonding member (54) is made of silicone rubber.

13. A method for mounting the window lite (46) in the remaining parts of the window structure (10) specified in claim 1, comprising:

(a) installing the stationary casing (22) and associated movable sash (26) in a selected location, with the stationary casing (22) substantially vertically oriented;

(b) with the sash (26) in its open position, placing setting blocks (52) made of a material capable of supporting the weight of the window lite (46) and having a selected thickness on a selected portion of the glazing support member (42) to support the weight of the window lite (46) and hold it in a selected location within the sash (26);

(c) setting the window lite (46) on the setting blocks (52), locating it at a selected distance from the mounting surface (40), and temporarily fixing it in place;

(d) closing the sash (26);

(e) injecting structural silicone rubber into the glazing channel (44) from the interior side of the window lite (46) adjacent to the sash opening (39), which structural silicone cures to form the structural bonding member (54).

14. The method for mounting a window lite (46) specified in claim 13 in which the step of temporarily fixing the window lite (46) in place includes installing retainer clips (78) having opposed grasping members (80) adapted to snap over the glazing support member (42) and to hold it therebetween in pinched relation, and also having a window lite retainer member (86) that is adapted to extend over the exterior surface (48) of the window lite (46) for a selected distance, the retainer clips (78) being installed by thrusting the opposed grasping members (80) over the glazing support member (42) until the window lite retainer member (86) comes to rest against the exterior surface (48) of the window lite (46).

* * * * *